US009316995B2

(12) United States Patent
Sumikura et al.

(10) Patent No.: US 9,316,995 B2
(45) Date of Patent: Apr. 19, 2016

(54) LOW PROFILE LIGHT SCANNING DEVICE AND IMAGE FORMING APPARATUS THEREWITH

(71) Applicant: KYOCERA Document Solutions Inc., Osaka (JP)

(72) Inventors: Noriaki Sumikura, Osaka (JP); Kosuke Uchida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/806,214

(22) Filed: Jul. 22, 2015

(65) Prior Publication Data

US 2016/0033923 A1 Feb. 4, 2016

(30) Foreign Application Priority Data

Jul. 29, 2014 (JP) ..... 2014-154010

(51) Int. Cl.

| | |
|---|---|
| ***G03G 15/01*** | (2006.01) |
| ***G03G 15/04*** | (2006.01) |
| ***G03G 15/05*** | (2006.01) |
| ***G03G 21/16*** | (2006.01) |
| ***G03G 21/00*** | (2006.01) |

(52) U.S. Cl.

CPC ..... *G03G 21/0005* (2013.01); *G03G 15/04* (2013.01); *G03G 15/04036* (2013.01); *G03G 15/011* (2013.01); *G03G 15/052* (2013.01); *G03G 21/1619* (2013.01); *G03G 21/1647* (2013.01); *G03G 21/1666* (2013.01); *G03G 2215/04* (2013.01); *G03G 2215/0402* (2013.01); *G03G 2215/0404* (2013.01); *G03G 2221/00* (2013.01); *G03G 2221/001* (2013.01); *G03G 2221/0005* (2013.01); *G03G 2221/1636* (2013.01)

(58) Field of Classification Search

CPC ... G03G 15/011; G03G 15/04; G03G 15/052; G03G 21/1619; G03G 21/1647; G03G 21/1666; G03G 2215/04; G03G 2215/0402; G03G 2215/0404; G03G 2221/00; G03G 2221/0005; G03G 2221/1636; G03G 2221/001; G03G 2221/0089; G03G 2221/1651; G03G 2221/1654; G03G 2221/1657; G03G 2221/1678; G03G 2221/1684; G03G 15/04036

See application file for complete search history.

(56) References Cited

U.S. PATENT DOCUMENTS

2009/0148173 A1* 6/2009 Tajima ..... G03G 15/0258 399/36

2012/0002999 A1* 1/2012 Itabashi ..... G03G 15/0258 399/100

FOREIGN PATENT DOCUMENTS

JP 2009-143108 A 7/2009

* cited by examiner

*Primary Examiner* — Joseph S Wong

(74) *Attorney, Agent, or Firm* — Stein IP, LLC

(57) ABSTRACT

A light scanning device includes a housing, a plurality of permeable members, a plurality of cleaning members, a plurality of cleaning holders, a linear member, and a driving unit. The plurality of permeable members close the respective plurality of the emission ports. The plurality of cleaning holders extend over the plurality of the permeable members adjacent to one another. The plurality of the cleaning holders each have a holding unit that holds at least the two cleaning members. The linear member is connected to the plurality of the cleaning holders. The driving unit causes the linear member to run circularly. The cleaning members each slide on the corresponding permeable member in association with the linear member running circularly. The cleaning holders each connected to the linear member at a center of the holding unit in an extending direction of the holding unit.

6 Claims, 6 Drawing Sheets

LOW PROFILE LIGHT SCANNING DEVICE AND IMAGE FORMING APPARATUS THEREWITH

INCORPORATION BY REFERENCE

This application is based upon, and claims the benefit of priority from, corresponding Japanese Patent Application No. 2014-154010 filed in the Japan Patent Office on Jul. 29, 2014, the entire contents of which are incorporated herein by reference.

BACKGROUND

Unless otherwise indicated herein, the description in this section is not prior art to the claims in this application and is not admitted to be prior art by inclusion in this section.

An image forming apparatus such as a color copier and a color printer, which employs an electrophotographic method, includes a light scanning device. The light scanning device irradiates a plurality of charged image carriers with a light so as to form an electrostatic latent image on each of the image carriers. A housing of the light scanning device includes a housing portion with one opening surface and a cover portion covering the opening. The housing portion internally embeds a scanning optical system. The cover portion includes emission ports formed for respective lights emitted from the scanning optical system corresponding to each of the image carriers. Further, the emission ports are each covered with a permeable member. The permeable member has a permeability to the light emitted from the scanning optical system.

Each of the permeable members is located to prevent toner, dust, or the like from entering inside of the light scanning device. If the toner, the dust, or the like attach to a part of or the whole of a plurality of optical components, which are located inside the light scanning device, their optical properties may deteriorate. The deterioration of the optical properties causes deterioration of a quality of an image formed on a recording-target medium such as a paper sheet.

Meanwhile, the optical properties may deteriorate when the toner, the dust, or the like attach to a part of an outer surface or the whole outer surface of each of the permeable members. In view of this, the outer surface of each of the permeable members needs to be cleaned regularly, and for example, there is proposed an automatic cleaning mechanism that cleans the outer surface of each permeable member automatically. This automatic cleaning mechanism includes a plurality of screw shafts that are located along with a longer side direction of each of the permeable members, and each of the screw shafts moves a plurality of cleaning members in the identical direction simultaneously. Each of the cleaning members slides on the outer surface of corresponding permeable member. This makes each of the permeable members cleaned simultaneously.

SUMMARY

A light scanning device for irradiating a plurality of image carriers with light so as to form an electrostatic latent image according to one aspect of the disclosure includes a housing, a plurality of permeable members, a plurality of cleaning members, a plurality of cleaning holders, a linear member, and a driving unit. The housing has a plurality of emission ports to emit the light. The plurality of the emission ports are located side by side corresponding to the plurality of the image carriers. The plurality of permeable members have permeability to the light and close the respective plurality of the emission ports. The plurality of cleaning members are located corresponding to the respective plurality of the permeable members. The plurality of cleaning holders extend over the plurality of the permeable members adjacent to one another. The plurality of the cleaning holders each have a holding unit that holds at least the two cleaning members. The linear member is tightly stretched circularly on the housing. The linear member is connected to the plurality of the cleaning holders. The driving unit causes the linear member to run circularly. The cleaning members each slide on the corresponding permeable member in association with the linear member running circularly. The cleaning holders each connected to the linear member at a center of the holding unit in an extending direction of the holding unit.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
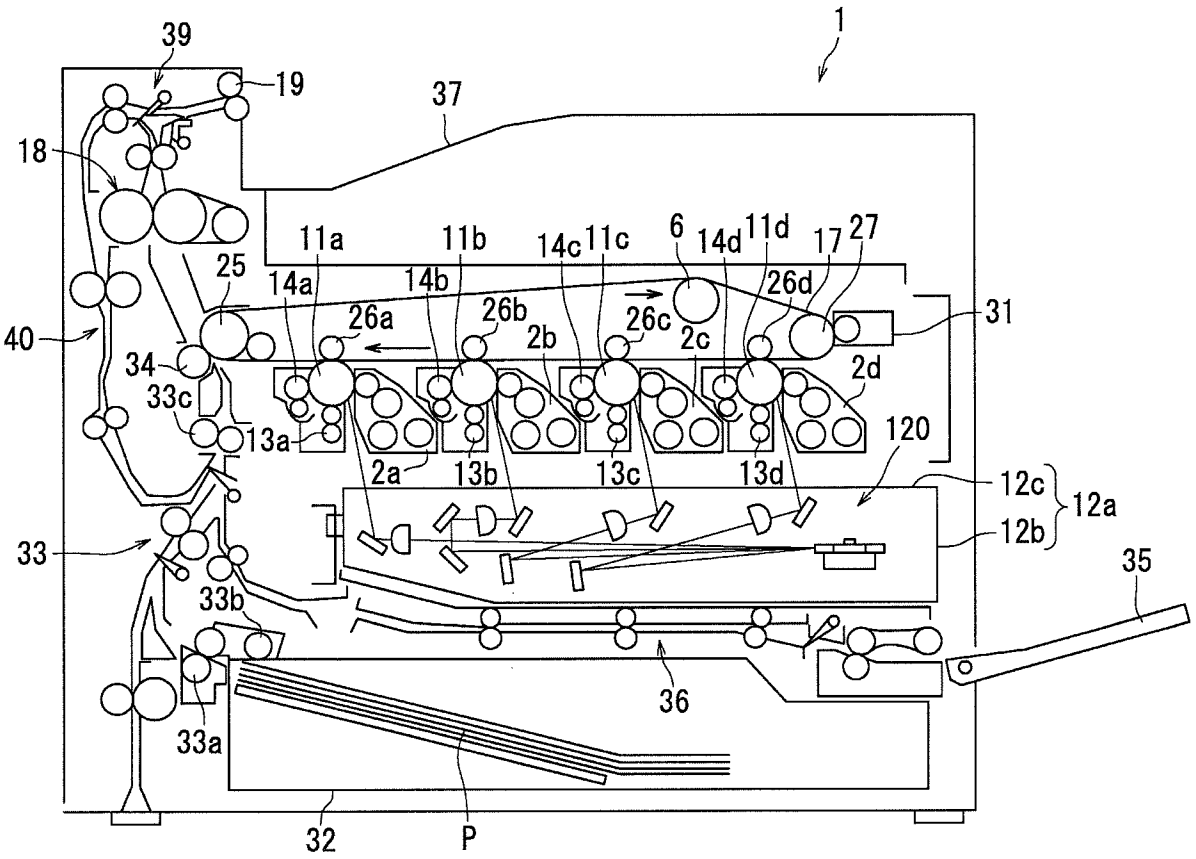
FIG. 1 schematically illustrates a cross section of an overall configuration of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of the disclosure with reference to the drawings. However, in the drawings, identical reference numerals are used to the identical or corresponding parts not to repeat explanations. In the drawings, mainly each component is indicated schematically for easy understanding. Accordingly, the illustrated thickness, length and similar factor of each component are different from the actual thickness, length and similar factor because of matters in preparing the drawings.

First, a description will be given of a structure of an image forming apparatus 1 of the embodiment with reference to FIG. 1. FIG. 1 is schematically illustrating a cross section of an overall configuration of the image forming apparatus 1.

The image forming apparatus 1 is a tandem type color printer. The image forming apparatus 1 includes rotatable photoreceptor drums 11*a* to 11*d* as a plurality of photoreceptors (image carriers). The photoreceptor drums 11*a* to 11*d* each employ an organic photoreceptor (OPC photoreceptor) with an organic photosensitive layer, an amorphous silicon photoreceptor with an amorphous silicon photosensitive layer, or similar photoreceptor. The photoreceptor drums 11*a* to 11*d* are located in tandem corresponding to respective colors of magenta, cyan, yellow, and black.

Around the photoreceptor drum 11*a*, a developing device 2*a*, a charger 13*a*, and a cleaning apparatus 14*a* are located. Similarly, around each of the photoreceptor drums 11*b* to 11*d*, developing devices 2*b* to 2*d*, chargers 13*b* to 13*d*, and cleaning apparatuses 14*b* to 14*d* are respectively located. A light scanning device 12 is located below the developing devices 2*a* to 2*d*. The light scanning device 12 irradiates the respective photoreceptor drums 11*a* to 11*d* with a light to form electrostatic latent images on the respective photoreceptor drums 11*a* to 11*d*. Note that "downward" and "upward" in this description indicates "downward" and "upward" in the drawings.

The developing devices 2*a* to 2*d* are located to the right side of the respective photoreceptor drums 11*a* to 11*d*. The developing devices 2*a* to 2*d* face the respective photoreceptor drums 11*a* to 11*d*, and supply toners to the respective photoreceptor drums 11*a* to 11*d*. Note that "right side" and "left side" in this description indicate "right side" and "left side" in the drawings.

The chargers 13*a* to 13*d* are located at respective upstream sides of the developing devices 2*a* to 2*d* in a rotation direction of the photoreceptor. The chargers 13*a* to 13*d* face respective surfaces of the photoreceptor drums 11*a* to 11*d*. The chargers 13*a* to 13*d* electrostatically charge the respective surfaces of the photoreceptor drums 11*a* to 11*d* uniformly.

The light scanning device 12 exposures each of the photoreceptor drums 11*a* to 11*d* by light scanning based on image data such as characters and patterns, which are input to an image input unit from a personal computer or similar device. The light scanning device 12 includes a housing 12*a* that includes a housing portion 12*b* with one opening surface and a cover portion 12*c* covering the opening. The housing portion 12*b* internally embeds a scanning optical system 120. The cover portion 12*c* includes emission ports formed for respective lights (laser beam) emitted from the scanning optical system 120 corresponding to the respective photoreceptor drums 11*a* to 11*d*. Further, as described below with reference to FIGS. 2 and 3, the emission ports are covered with respective permeable members. The permeable members each have a permeability to each of the lights emitted from the scanning optical system 120.

The scanning optical system 120 includes a laser light source (not shown) and a polygon mirror. The scanning optical system 120 includes at least one reflection mirror and a lens corresponding to each of the photoreceptor drums 11*a* to 11*d*. The laser beam emitted from the laser light source is irradiated to the surfaces of the photoreceptor drums 11*a* to 11*d* from the respective downstream sides of the chargers 13*a* to 13*d* in a rotation direction of the photoreceptor via the polygon mirror, a reflection mirror group, and a lens group. The irradiated laser beam forms the electrostatic latent images on the respective surfaces of the photoreceptor drums 11*a* to 11*d*. The developing devices 2*a* to 2*d* develop these respective electrostatic latent images to make them into toner images.

An endless intermediate transfer belt 17 is stretched over a tension roller 6, a drive roller 25, and a driven roller 27. The drive roller 25 is rotationally driven by a motor (not shown). The drive roller 25 rotates to cause the intermediate transfer belt 17 to be circulated.

The photoreceptor drums 11*a* to 11*d* are located adjacent to one another along a conveyance direction (See arrow direction in FIG. 1) under the intermediate transfer belt 17. The photoreceptor drums 11*a* to 11*d* each contact the intermediate transfer belt 17. Primary transfer rollers 26*a* to 26*d* respectively face the photoreceptor drums 11*a* to 11*d* to sandwich the intermediate transfer belt 17. The primary transfer rollers 26*a* to 26*d* are each brought into pressure contact with the intermediate transfer belt 17 to form a primary transfer unit with the respective photoreceptor drums 11*a* to 11*d*. In each of these primary transfer units, the toner image is transferred to the intermediate transfer belt 17. Specifically, the intermediate transfer belt 17 rotates to cause the toner images on the photoreceptor drums 11*a* to 11*d* to be transferred to the intermediate transfer belt 17 sequentially at a predetermined time point. This forms a full-color toner image on the surface of the intermediate transfer belt 17. The full-color toner image is a toner image where four colors toner images, which colors are magenta, cyan, yellow, and black, are superimposed.

A secondary transfer roller 34 faces the drive roller 25 to sandwich the intermediate transfer belt 17. The secondary transfer roller 34 is brought into pressure contact with the intermediate transfer belt 17 to forms a secondary transfer unit with the drive roller 25. In this secondary transfer unit, the toner image on the surface of the intermediate transfer belt 17 is transferred to a paper sheet P. After the toner image is transferred, a belt cleaning apparatus 31 cleans a toner remained on the intermediate transfer belt 17.

A sheet feed cassette 32 is located on the lower side in the image forming apparatus 1. The sheet feed cassette 32 can store a plurality of paper sheets P. On the right side of the sheet feed cassette 32, a stack tray 35 for manual paper feeding is located. On the left side of the sheet feed cassette 32, a first paper sheet conveyance passage 33 is located. The first paper sheet conveyance passage 33 feeds the paper sheet P, which is sent from the sheet feed cassette 32, to the secondary transfer unit. On the left side of the stack tray 35, a second paper sheet conveyance passage 36 is located. The second paper sheet conveyance passage 36 feeds paper sheets, which are sent from the stack tray 35, to the secondary transfer unit. Further, on the upper left side in the image forming apparatus 1, a fixing unit 18 and a third paper sheet conveyance passage 39 are located. The fixing unit 18 performs a fixing process on the paper sheet P on which the image has been formed. The third paper sheet conveyance passage 39 feeds the paper sheet P, on which the fixing process has been performed, to a paper sheet discharge unit 37.

The sheet feed cassette 32 can be extracted outside the main body of the image forming apparatus 1 (See the front side in FIG. 1). This ensures the paper sheet P to be replenished in the sheet feed cassette 32. The paper sheet P, which is stored in the sheet feed cassette 32, is sent to the first paper sheet conveyance passage 33 side by a pickup roller 33*b* and a separation roller pair 33*a*. When a plurality of paper sheets P are stored in the sheet feed cassette 32, the pickup roller 33*b* and the separation roller pair 33*a* send the paper sheet P one by one to the first paper sheet conveyance passage 33 side.

The first paper sheet conveyance passage 33 and the second paper sheet conveyance passage 36 merge before reaching a registration roller pair 33*c* (which is upstream side). The registration roller pair 33*c* feeds the paper sheet P to the secondary transfer unit. The registration roller pair 33*c* synchronizes the timings of the image forming operation on the intermediate transfer belt 17 and the paper feeding operation to the secondary transfer unit. The secondary transfer roller 34, to which a bias potential is applied, performs a transfer process on the paper sheet P, which is fed to the secondary transfer unit, so as to secondary transfer the full-color toner image on the intermediate transfer belt 17. The paper sheet P on which the full-color toner image is transferred is fed to the fixing unit 18.

The fixing unit 18 includes a fixing belt, a fixing roller, a pressure roller, and similar members. The fixing belt is heated by a heater. The fixing roller contacts the inside of the fixing belt. The pressure roller is brought into pressure contact with the fixing roller to sandwich the fixing belt. The fixing unit 18 heats and applies pressure to the paper sheet P on which the toner image has been transferred. This performs the fixing process. After the fixing unit 18 has fixed the toner image on the paper sheet P, a fourth paper sheet conveyance passage 40 inverts this paper sheet P as necessary. This causes the secondary transfer roller 34 to perform the secondary transfer of the toner image to a reverse side of this paper sheet P, and the toner image is fixed by the fixing unit 18. A discharge roller pair 19 discharges the paper sheet P, on which this toner image has been fixed, passing through the third paper sheet conveyance passage 39 to the paper sheet discharge unit 37.

Figure 2:
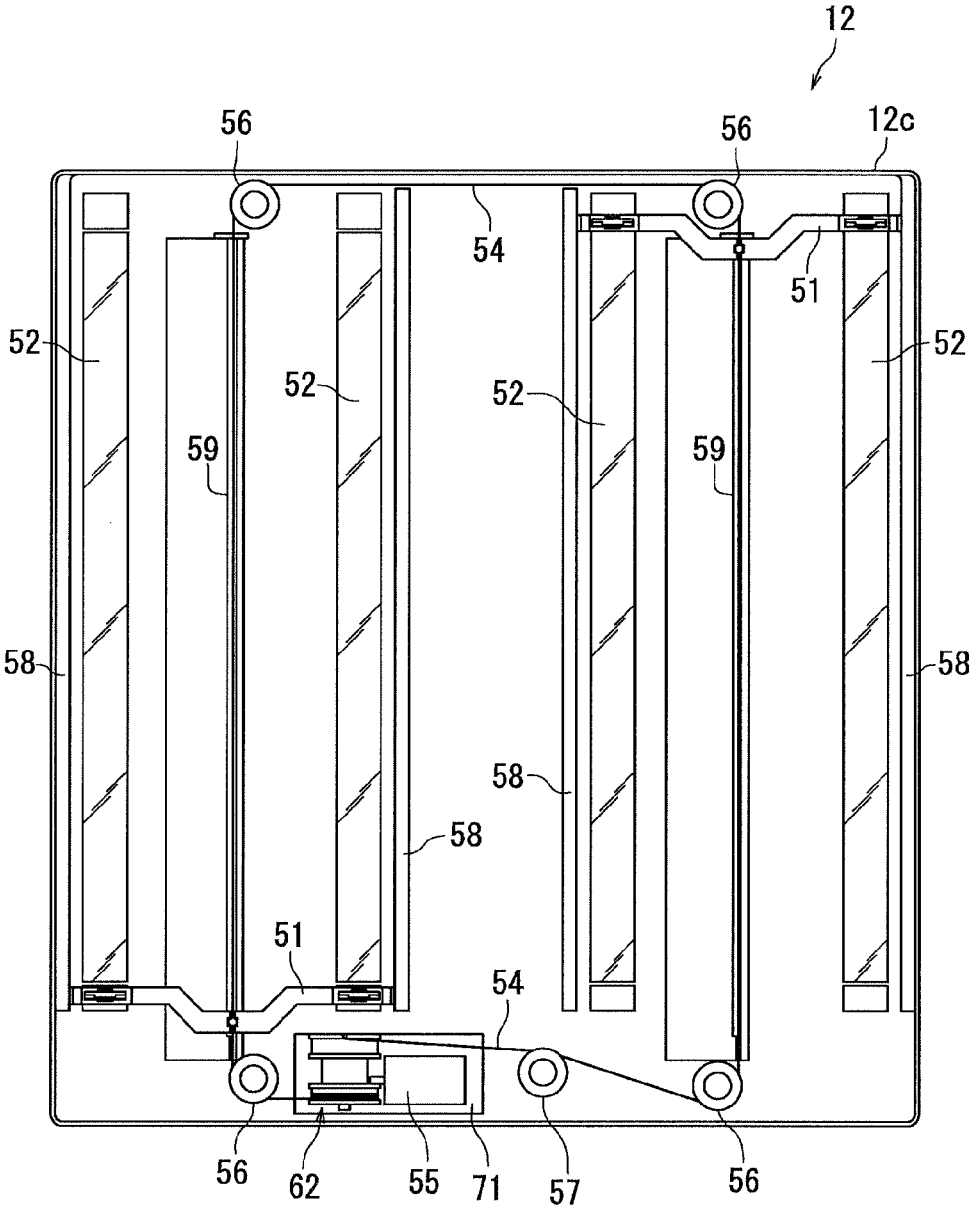
FIG. 2 illustrates a cover portion of a light scanning device according to the one embodiment.
Figure 3:
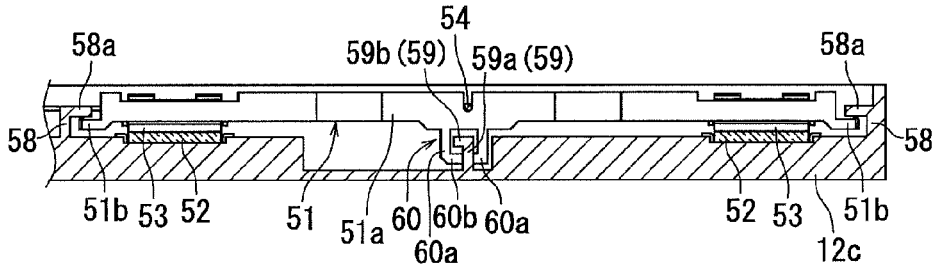
FIG. 3 illustrates a part of the cover portion according to the one embodiment.

Next, a description will be given of the light scanning device 12 with reference to FIGS. 2 and 3. FIG. 2 illustrates the cover portion 12*c* of the light scanning device 12 in a plan view. FIG. 3 illustrates a cross section of a part of the cover portion 12*c* indicating a cleaning holder 51 located over the cover portion 12*c* from the front view.

As described above, the housing 12*a* of the light scanning device 12 includes the housing portion 12*b* and the cover portion 12*c* attached to the housing portion 12*b*. The cover portion 12*c* includes four laser beam emission ports located side by side corresponding to the respective photoreceptor drums 11*a* to 11*d*. The emission ports each have a rectangular shape with long sides in a main-scanning direction of the corresponding laser beam, and the emission ports are formed so as to have the longer side directions parallel to one another. The four emission ports are each closed by a permeable member 52 in a rectangular plate shape. The four permeable members 52 are located side by side so as to have the longer side directions parallel to one another. The permeable members 52 are each, for example, a glass cover, and located to prevent the toner, the dust, or the like from entering inside of the light scanning device 12.

In this embodiment, the light scanning device 12 includes two cleaning holders 51, while the cleaning holders 51 each have a holding unit 51*a*. The holding unit 51*a* extends over the two permeable members 52, which are adjacent to each other, and holds two cleaning members 53. The cleaning holders 51 are each located on the outer surface of the cover portion 12*c* (a surface of the photoreceptor drums 11*a* to 11*d* side). The cleaning members 53 are each held onto the holding unit 51*a* of each of the cleaning holders 51 so as to be located corresponding to each of the permeable members 52. The cleaning members 53 are each, for example, a rubber pad. As the material of the rubber pad, such as silicon rubber can be employed. The cleaning holders 51 are each formed of resin, for example. The cleaning members 53 are each not limited to the rubber pad. The cleaning members 53 may be each a nonwoven fabric, for example.

The cleaning holders 51 are each connected to a linear member 54 that is tightly stretched circularly so as to pass through between the adjacent permeable members 52. The linear member 54 runs circularly by driving power of a winding motor 55 as a driving unit. The linear member 54 is a wire, for example.

The four cleaning members 53 slide on the outer surfaces of the four permeable members 52 (surfaces of the photoreceptor drums 11*a* to 11*d* side) in association with the linear member 54 running circularly. This ensures the outer surfaces of the four permeable members 52 to be cleaned simultaneously by the respective corresponding cleaning members 53.

In this embodiment, in association with the linear member 54 running circularly, the two cleaning holders 51 move linearly in opposite directions each other along the longer side directions of the respective permeable members 52 (the main-scanning direction of the laser beam). At this time, the two cleaning members 53 held onto the respective cleaning holders 51 move in the identical direction. Here, assuming that one cleaning holder holds one cleaning member 53, because the cleaning holder is necessary to the number of the permeable member 52, the length of the linear member 54 for moving the cleaning holder becomes long compared with the case where one cleaning holder 51 holds a plurality of the cleaning members 53 as this embodiment. Accordingly, this embodiment can reduce the number of the cleaning holders and the necessary length of the linear member 54, thus saving the cost.

The winding motor 55 can rotate in forward and reverse directions. This ensures the execution of a cleaning process of each of the permeable members 52 repeatedly. In this embodiment, one time cleaning process rotates the winding motor 55 in forward and reverse directions for causing the corresponding cleaning members 53 to run back and forth along the longer side directions of the respective permeable members 52. The cleaning process is executed by a user operation to an input device such as a touch panel while the image forming apparatus 1 is in a state of maintenance mode. Also, for example, the cleaning process may be executed regularly every time when the print jobs (image formation) about ten thousand paper sheets are performed.

Further, in this embodiment, four tight stretching pulleys 56 are rotatably held onto the outer surface of the cover portion 12*c*. The four tight stretching pulleys 56 are located to tightly stretch the linear member 54 in a predetermined circular shape. A tension adjust pulley 57 is rotatably held onto the outer surface of the cover portion 12*c*. The linear member 54 is tightly stretched circularly between a plurality of the tight stretching pulleys 56 and the tension adjust pulley 57. Specifically, the linear member 54 is tightly stretched between the two permeable members 52 adjacent to each other by the four tight stretching pulleys 56 such that the linear member 54 is parallel to the longer side directions of the respective permeable members 52. The tension adjust pulley 57 is an example of a tension control mechanism. The tension adjust pulley 57 is located to adjust a tensile force provided to the linear member 54. Thus, use of the rotatable tight stretching pulleys 56 and the tension adjust pulley 57 to tightly stretch the linear member 54 circularly ensures a smooth circular run of the linear member 54.

The cleaning holders 51 each connected to the linear member 54 at a position (a balance point) or at proximity of the position where a force (a load caused by a friction force) acting on each of the cleaning holders 51 by sliding of each of the cleaning members 53, which is held by each of the cleaning holders 51, can balance. Specifically, in this embodiment, the cleaning holders 51 each connected to the linear member 54 at the center of the holding unit 51*a* in an extending direction. The two cleaning members 53 of each of the cleaning holders 51 are symmetrically located in the extending direction of the holding unit 51*a*.

According to this embodiment, the linear member 54, which is tightly stretched circularly, runs circularly so as to cause the cleaning members 53 to slide on the corresponding permeable members 52, thus simultaneously cleaning the outer surfaces of the respective permeable members 52. Accordingly, employing one linear member 54 is enough to move each of the cleaning members 53 and reduces the necessary length of the linear member 54 compared with the case employing a configuration that the four cleaning members are moved individually. Then, adjusting the height position of the linear member 54 ensures the low profile light scanning device 12.

Further, according to this embodiment, the cleaning holders 51 each connected to the linear member 54 at a position or at proximity of the position where a force acting on each of the cleaning holders 51 by sliding of each of the cleaning members 53, which is held by each of the cleaning holders 51, can balance. This ensures stabilizing the posture of each of the cleaning holders 51, which moves along each of the longer side directions of the permeable members 52, and this results in the stabilized postures of the respective cleaning members 53 with respect to the respective permeable members 52 in a cleaning process. Accordingly, this ensures reliably cleaning each of the permeable members 52.

In this embodiment, each of the cleaning holders 51 movably engages the cover portion 12*c* along the longer side direction of each of the permeable members 52. The following describes an exemplary engagement of each of the cleaning holders 51 and the cover portion 12*c* with reference to FIGS. 2 and 3.

As illustrated in FIGS. 2 and 3, in this embodiment, two sets of a pair of guide rails 58 are located on the outer surface of the cover portion 12*c*. The pair of the guide rails 58 is one example of a first guiding member. Each of the guide rails 58 runs along the longer side direction of each of the permeable members 52, and both end portions of each of the cleaning holders 51 engage the pair of the guide rails 58. The pair of the guide rails 58 guides each of the cleaning holders 51 along the longer side direction of each of the permeable members 52. Accordingly, each of the cleaning holders 51 can be moved stably along the longer side direction of each of the permeable members 52.

Each of the guide rails 58 includes a lock portion 58*a* that projects heading for the corresponding cleaning holder 51. Each of the lock portions 58*a* runs along the longer side direction of each of the permeable members 52. Both end portions of each of the cleaning holders 51 are locked to the lock portions 58*a* of the pair of the guide rails 58 in a direction away from the housing 12*a* of the light scanning device 12 (upper direction in FIG. 3). This restricts a movement of each of the cleaning holders 51 in the upper direction (positional displacement). Further, this ensures not only each of the lock portions 58*a* to prevent each of the cleaning holders 51 from detaching from the cover portion 12*c*, but also each of the cleaning members 53 to be in close contact stably with each of the permeable members 52. More preferably, each of the lock portions 58*a* is located such that both end portions of each of the cleaning holders 51 are constantly in contact with the lock portion 58*a* of the pair of the guide rails 58. This ensures each of the cleaning members 53 to be pressed to the corresponding permeable member 52. Accordingly, each of the cleaning members 53 can be in close contact more stably with each of the permeable members 52.

In this embodiment, projecting portions 51*b* are located at each of both end portions of the holding unit 51*a* of each of the cleaning holders 51. Each of the projecting portions 51*b* projects from both end portions of the holding unit 51*a* to downward and outward. Then, the top surface of each of the projecting portions 51*b* is in abutting contact with the inferior surface of the lock portion 58*a* of each of the guide rails 58. This ensures each of the cleaning holders 51 to be locked to the lock portion 58*a* of the pair of the guide rails 58 in the direction away from the housing 12*a* of the light scanning device 12 (upper direction).

Further, in this embodiment, two guide ribs 59 are located projecting from the outer surface of the cover portion 12*c*. The guide rib 59 is one example of a second guiding member. Each of the guide ribs 59 runs along the longer side direction of each of the permeable members 52 in the center of the two adjacent permeable members 52. On the other hand, an engaging portion 60 is located on the lower end portion side of the holding unit 51*a* of each of the cleaning holders 51, and the engaging portion 60 of each of the cleaning holders 51 engages each of the guide ribs 59. Accordingly, each of the guide ribs 59 guides each of the cleaning holders 51 along the longer side direction of each of the permeable members 52. This ensures each of the cleaning holders 51 to be moved stably along the longer side direction of each of the permeable members 52.

Each of the guide ribs 59 is preferred to be located at a position closer to the linear member 54. This reduces the swing of each of the cleaning holders 51 in the cleaning process. That is, each of the cleaning holders 51 can be moved more stably along the longer side direction of each of the permeable members 52. More preferably, each of the guide ribs 59 is located immediately below the linear member 54. This further reduces the swing of each of the cleaning holders 51 in the cleaning process.

In this embodiment, the linear member 54 is coupled on the upper end portion side of the holding unit 51*a* of each of the cleaning holders 51, and each of the engaging portions 60 is located on the lower end portion side of the holding unit 51*a* of each of the cleaning holders 51. This ensures an engage part of each of the engaging portions 60 and each of the guide ribs 59 to be located immediately below a coupling portion of the holding unit 51*a* of each of the cleaning holders 51 and the linear member 54.

In this embodiment, each of the engaging portions 60 includes a pair of projecting portions 60*a* projecting from the holding unit 51*a* to downward, and each of the guide ribs 59 is located between the pair of the projecting portions 60*a*. This restricts a movement of each of the cleaning holders 51 in a lateral direction. Also, this restricts the swing of each of the cleaning holders 51 around an axis extending in a vertical direction (swing in a moving direction of the cleaning holder 51).

In this embodiment, each of the guide ribs 59 includes a projecting portion 59*a* projecting from the cover portion 12*c* and a first lock portion 59*b* extending from a distal end portion of this projecting portion 59*a* leftward (one direction in the extending direction of the holding unit 51*a*). On the other hand, one projecting portion 60*a* of the pair of the projecting portions 60*a* of each of the engaging portions 60 extends rightward of the distal end portion of the projecting portion 60*a* (the other direction in the extending direction of the holding unit 51*a*) and includes a second lock portion 60*b* engaging the first lock portion 59*b*. This restricts each of the cleaning holders 51 from moving in the vertical direction. Also, this prevents each of the cleaning holders 51 from detaching from the cover portion 12*c*.

When bringing both end portions of each of the cleaning holders 51 constantly in contact with the lock portion 58*a* of the pair of the guide rail 58 so as to bring each of the cleaning members 53 into close contact with the corresponding permeable member 52, each of the cleaning holders 51 may deform in an arcuate shape. When each of the cleaning holders 51 deforms in the arcuate shape, each of the cleaning members 53 may detach from the permeable member 52 in the center side of each of the cleaning holders 51. In contrast to this, in this embodiment, the cover portion 12*c* includes the first lock portion 59*b*, and the cleaning holder 51 includes the second lock portion 60*b*. Then, when the cleaning holder 51 deforms in the arcuate shape, the second lock portion 60*b* of the cleaning holder 51 locks the first lock portion 59*b* of each of the guide ribs 59 in the direction away from the housing 12*a* of the light scanning device 12 (upward direction). This restricts the deformation of each of the cleaning holders 51 in the arcuate shape so as to provide each of the permeable members 52*a* stable close contact with the corresponding cleaning member 53. More preferably, the first lock portion 59*b* of each of the guide ribs 59 is configured to lock the second lock portion 60*b* of the cleaning holder 51 below the position where each of the permeable members 52 is located. This enhances the effect to minimize the deformation of each of the cleaning holders 51 in the arcuate shape.

Figure 4:
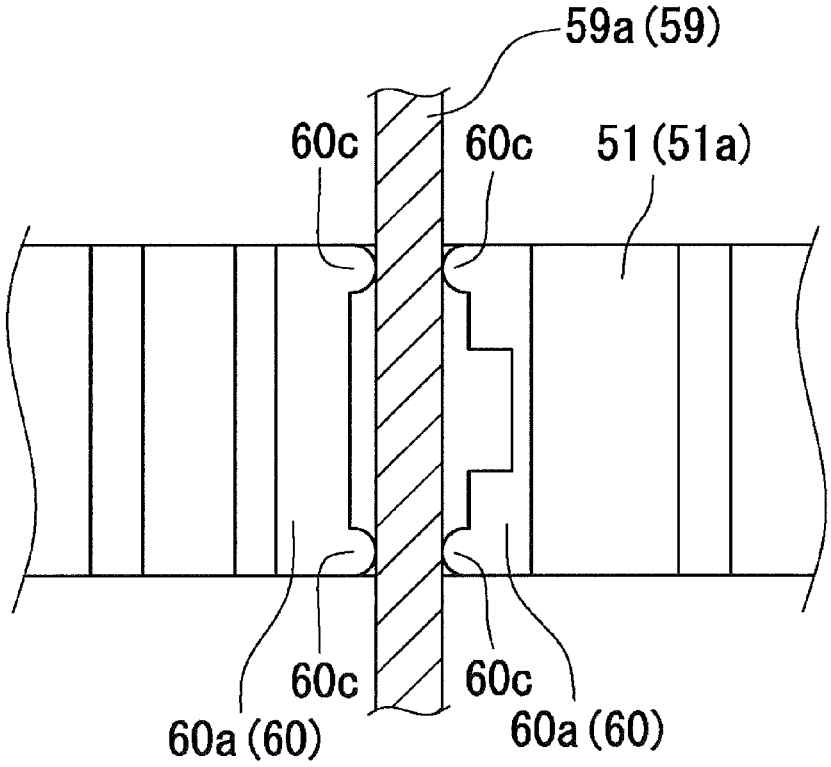
FIG. 4 illustrates an engagement of a guide rib and an engaging portion according to the one embodiment.

FIG. 4 is a partially enlarged view illustrating an engagement of the guide rib 59 and the engaging portion 60, and is a schematic diagram viewing the cleaning holder 51 from the lower side. As illustrated in FIG. 4, in this embodiment, each of the pair of the projecting portions 60*a* includes at least one protrusion 60*c* that projects heading for the corresponding guide rib 59. In this embodiment, each of the projecting portions 60*a* of the pair of the projecting portions 60*a* includes two protrusions 60*c*. Then, the pair of the projecting portions 60*a* includes four protrusions 60*c* in total. Each of the protrusions 60*c* has a semicircle shape in plan view, and the project end portion is in abutting contact with the projecting portion 59*a* of the guide rib 59. This configuration reduces the contacted area of the engaging portion 60 and the guide rib 59, thus causing each of the cleaning holders 51 to move smoothly.

Preferably, a plurality of the protrusions 60*c* is located on each of the projecting portions 60*a* of the pair of the projecting portions 60*a*. This restricts each of the cleaning holders 51 from swinging around an axis extending in the vertical direction (swing in a moving direction of the cleaning holder 51) more. More preferably, each of the protrusions 60*c* constantly contacts the corresponding guide rib 59. This further restricts a lateral movement and a swing of each of the cleaning holders 51. Further preferably, each of the protrusions 60*c* located on the pair of the projecting portions 60*a* is located symmetry to each other. This further restricts the lateral movement and the swing of each of the cleaning holders 51.

Figure 5:
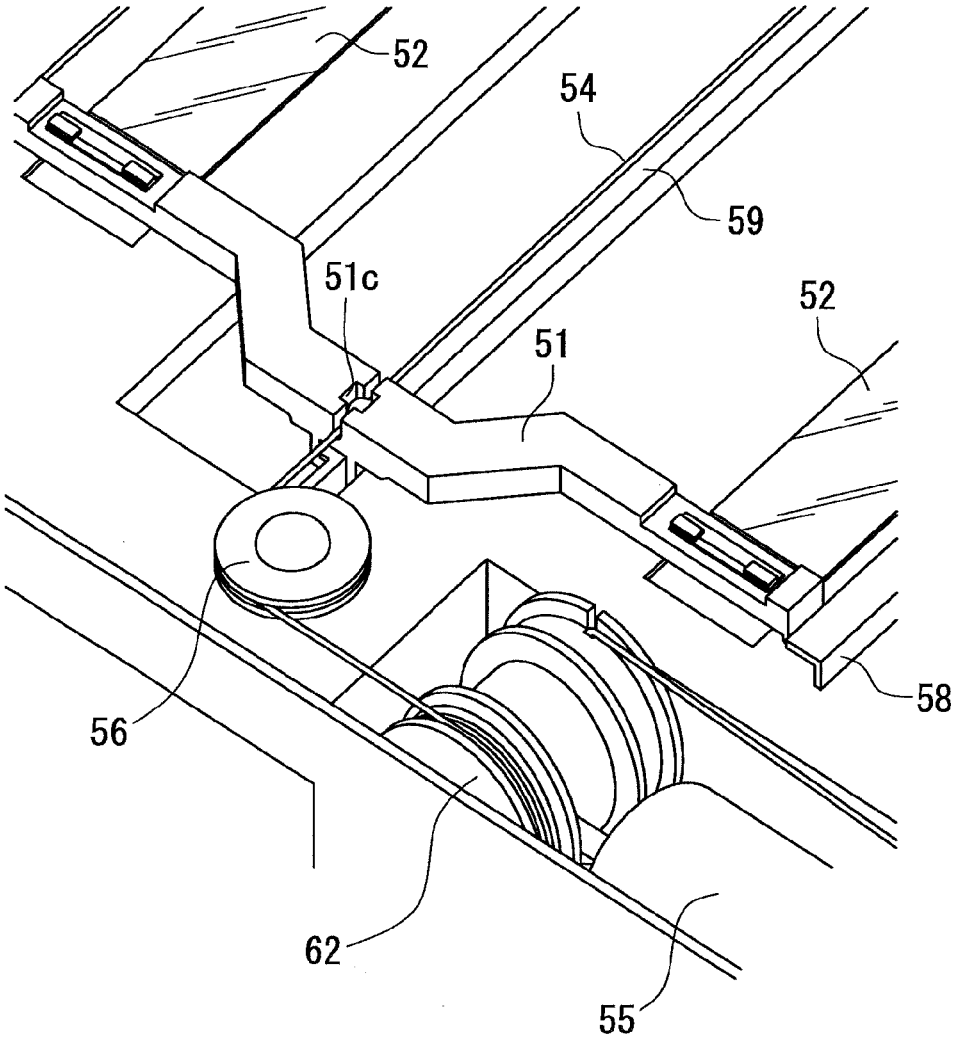
FIG. 5 illustrates an enlarged part of the cover portion according to the one embodiment.
Figure 6:
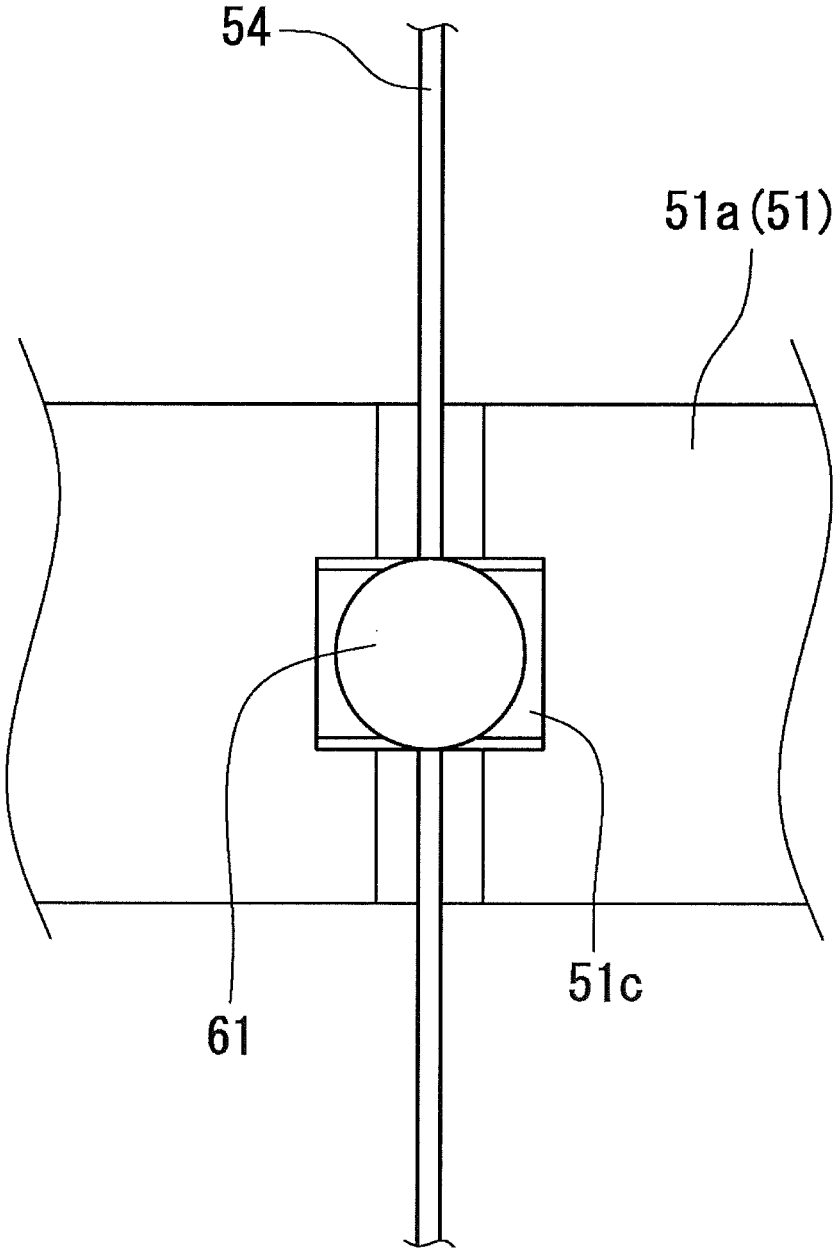
FIG. 6 illustrates an enlarged part of a cleaning holder according to the one embodiment.

Next, an exemplary method to couple each of the cleaning holders 51 to the linear member 54 will be described with reference to FIGS. 5 and 6. FIG. 5 is a perspective view of the partially enlarged cover portion 12*c*, and FIG. 6 is a plan view of the partially enlarged cleaning holder 51.

In this embodiment, a spherical coupling member 61 is secured to the linear member 54 corresponding to each of the cleaning holders 51. Then, a concave portion 51*c* is formed at the upper end portion of the holding unit 51*a* of each of the cleaning holders 51, and the coupling member 61 is freely fit to each of the concave portions 51*c*. This couples each of the cleaning holders 51 to the linear member 54. Each of the coupling members 61 may be secured with caulked to the linear member 54, for example. As the material of the coupling member 61, a resin can be employed for example.

If the posture of the cleaning holder 51 varies due to the swing or similar reason, this configuration reduces the load applied to the linear member 54 by the posture-varied cleaning holder 51. Accordingly, this configuration ensures the prolonged life of the linear member 54.

Figure 7:
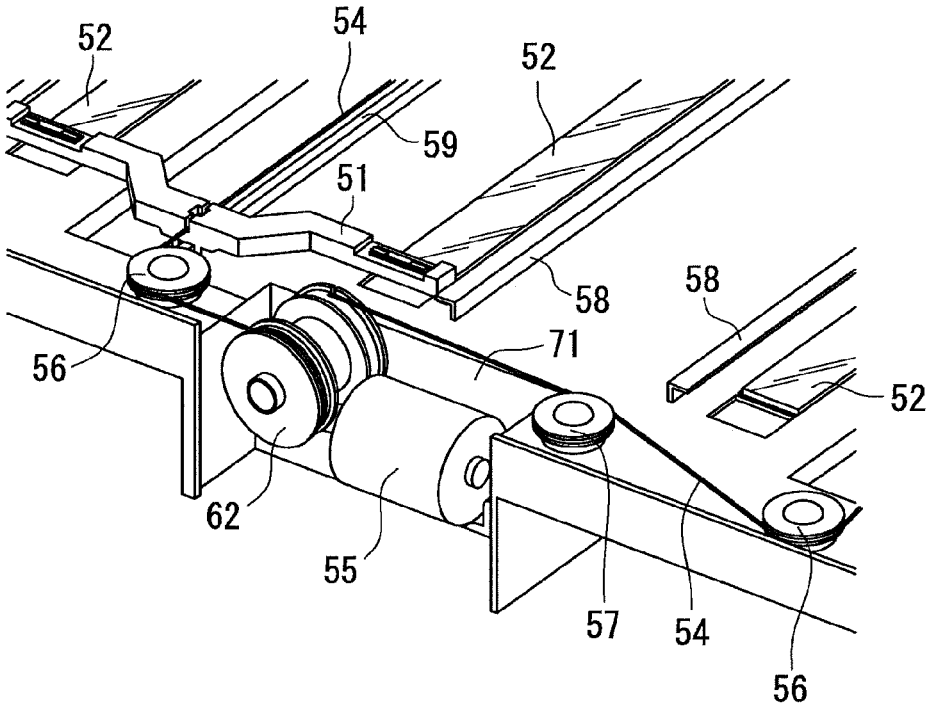
FIG. 7 illustrates an enlarged part of the cover portion according to the one embodiment.

Next, an exemplary arrangement of the winding motor 55 will be described with reference to FIGS. 2 and 7. FIG. 7 perspectively illustrates an enlarged part of the cover portion 12*c* omitting a part of the cover portion 12*c*.

As illustrated in FIG. 7, the linear member 54 is wound around a winding drum 62 many times. In this embodiment, the winding motor 55 causes the winding drum 62 to rotate to make the linear member 54 run circularly.

As illustrated in FIGS. 2 and 7, in this embodiment, the cover portion 12*c* includes a concave portion 71, and the winding motor 55 and the winding drum 62 are located in the concave portion 71. Specifically, the winding drum 62 is held onto the cover portion 12*c* rotatably within the concave portion 71. The winding motor 55 is secured to the cover portion 12*c* within the concave portion 71. The winding motor 55 may be secured to the housing portion 12*b*.

This configuration ensures the winding motor 55 and the winding drum 62 to be located at a lower position than a height position of the tightly stretched linear member 54. Accordingly, this configuration prevents a part where the winding motor 55 and the winding drum 62 are located from projecting toward the housing 12*a* of the light scanning device 12 over the linear member 54. Then, this configuration ensures the further reduced profile (height) of the light scanning device 12. Use of the winding drum 62 causes the linear member 54 to run stably.

The winding motor 55 and the winding drum 62 are preferred to be located between the tight stretching pulleys 56 adjacent to one another in a direction where the permeable members 52 are located side by side (lateral direction in FIG. 2). This achieves space saving.

Embodiments of the disclosure are described above. It will be appreciated that the disclosure will not be limited to the embodiments described above, but various modifications can be made to the embodiments described above.

For example, in the above-described embodiment, the tight stretching pulley 56 is used to tightly stretch the linear member 54 circularly. However, the member to tightly stretch the linear member 54 circularly is not limited to the pulley. For example, instead of the tight stretching pulley 56, a plurality of protrusions may be located on the outer surface of the cover portion 12*c* for the linear member 54 to stretch over each of the protrusions. Similarly, as the tension control mechanism, instead of the tension adjust pulley 57, at least one protrusion may be located on the outer surface of the cover portion 12*c*.

While in the above-described embodiment one tension adjust pulley 57 is located, the number of the tension adjust pulleys 57 is not limited specifically.

While in the above-described embodiment the tension adjust pulley 57 is located as the tension control mechanism that controls a tensile force provided to the linear member 54, the tension control mechanism may be omitted.

While in the above-described embodiment the winding drum 62 is located, the winding drum 62 may be omitted.

While in the above-described embodiment, a case where a recording-target medium is a paper sheet is described, the recording-target medium may be other than the paper sheet (such as a resin sheet and a fabric).

While in the above-described embodiment, a tandem type color printer is described as an example, the disclosure is not limited to this and applicable to an image forming apparatus that employs electrophotographic method such as a color copier and a facsimile.

While in the above-described embodiment the light scanning device 12 is located under the photoreceptor drums 11*a* to 11*d*, the light scanning device 12 may be located over the photoreceptor drums 11*a* to 11*d*.

The material, the shape and similar factor of each component indicated in the above-described embodiment is merely an example and not limited specifically. Many variations thereof are possible without departing substantially from the efficiency of the disclosure.

Besides, various modifications can be made to the embodiments described above without departing from the gist of the disclosure.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A light scanning device for irradiating a plurality of image carriers with light so as to form an electrostatic latent image, comprising:

a housing having a plurality of emission ports to emit the light, the plurality of the emission ports being located side by side corresponding to the plurality of the image carriers;

a plurality of permeable members that have permeability to the light and close the respective plurality of the emission ports;

a plurality of cleaning members located corresponding to the respective plurality of the permeable members;

a plurality of cleaning holders that extend over the plurality of the permeable members adjacent to one another, the plurality of the cleaning holders each having a holding unit that holds at least the two cleaning members;

a linear member tightly stretched circularly on the housing, the linear member being connected to the plurality of the cleaning holders; and a driving unit causing the linear member to run circularly, wherein the cleaning members each slide on the corresponding permeable member in association with the linear member running circularly, wherein the cleaning holders are each connected to the linear member at a center of the holding unit in an extending direction of the holding unit, wherein the housing includes a first guiding member that engages both end portions of the holding unit of each of the cleaning holders, so as to guide each of the cleaning holders to move and so as to restrict each of the cleaning holders from moving in a direction away from the housing, wherein the cleaning holders further each include an engaging portion projecting from the holding unit, wherein the housing includes a second guiding member that engages the engaging portion of each of the cleaning holders, so as to guide each of the cleaning holders to move and so as to restrict each of the cleaning holders from moving in the extending direction, wherein the second guiding member includes a projecting portion projecting from the housing and a first lock portion extending in one direction of the extending direction from the projecting portion, and wherein the engaging portion includes a pair of projecting portions projecting from the holding unit and a second lock portion extending in another direction of the extending direction from one of the pair of the projecting portions, the second lock portion engaging the first lock portion.

2. The light scanning device according to claim 1, wherein the linear member is connected to an upper end portion side of the holding unit, and the engaging portion is located in a lower end portion side of the holding unit.

3. The light scanning device according to claim 2, wherein an engaging part of the engaging portion and the second guiding member is located immediately below a coupling portion of the cleaning holder and the linear member.

4. A light scanning device for irradiating a plurality of image carriers with light so as to form an electrostatic latent image, comprising:

a housing having a plurality of emission ports to emit the light, the plurality of the emission ports being located side by side corresponding to the plurality of the image carriers;

a plurality of permeable members that have permeability to the light and close the respective plurality of the emission ports;

a plurality of cleaning members located corresponding to the respective plurality of the permeable members;

a plurality of cleaning holders that extend over the plurality of the permeable members adjacent to one another, the plurality of the cleaning holders each having a holding unit that holds at least the two cleaning members;

a linear member tightly stretched circularly on the housing, the linear member being connected to the plurality of the cleaning holders; and a driving unit causing the linear member to run circularly, wherein the cleaning members each slide on the corresponding permeable member in association with the linear member running circularly, wherein the cleaning holders are each connected to the linear member at a center of the holding unit in an extending direction of the holding unit, wherein the holding unit has a concave portion, wherein the linear member is secured to a spherical coupling member, and wherein the cleaning holders are each connected to the linear member with the coupling member freely fit to the concave portion of the holding unit.

5. An image forming apparatus comprising:

a plurality of image carriers; and a light scanning device according to claim 1, wherein the light scanning unit irradiates the plurality of the image carriers with the light so as to form the electrostatic latent image.

6. An image forming apparatus comprising:

a plurality of image carriers; and a light scanning device according to claim 1, wherein the light scanning unit irradiates the plurality of the image carriers with the light so as to form the electrostatic latent image.

* * * * *